US006019138A

United States Patent [19]

Malek et al.

[11] Patent Number: 6,019,138

[45] Date of Patent: Feb. 1, 2000

[54] AUTOMATED THREE-DIMENSIONAL METHOD FOR MAKING INTEGRALLY STIFFENED SKIN PANELS

[75] Inventors: Ahmed Ezzeldin Malek, Beverly, Mass.; Christopher Michael Pastore, Maple Glen, Pa.

[73] Assignee: Northrop Grumman Corporation, Los Angeles, Calif.

[21] Appl. No.: 09/284,267

[22] PCT Filed: Mar. 21, 1997

[86] PCT No.: PCT/US97/04545

§ 371 Date: Jun. 16, 1999

§ 102(e) Date: Jun. 16, 1999

[87] PCT Pub. No.: WO98/42901

PCT Pub. Date: Oct. 1, 1998

[51] Int. Cl.[7] ..... D03D 41/00; D03D 3/00

[52] U.S. Cl. ..... 139/1 R; 139/11; 139/384; 139/384 R; 139/DIG. 1

[58] Field of Search ..... 139/1 R, 11, 384 R, 139/384, 385, 385.5, DIG. 1; 428/116, 225, 113; D03D 41/00, 3/00

[56] References Cited

U.S. PATENT DOCUMENTS

| | | | |
|---|---|---|---|
| 4,725,485 | 2/1988 | Hirokawa | 428/225 |
| 5,021,281 | 6/1991 | Bompard et al. | 428/116 |
| 5,137,058 | 8/1992 | Anahara et al. | 139/384 R |
| 5,211,967 | 5/1993 | Yasui et al. | 428/225 |
| 5,236,020 | 8/1993 | Sakatani et al. | 139/384 |
| 5,270,094 | 12/1993 | Anahara et al. | 428/113 |
| 5,343,897 | 9/1994 | Sakatani et al. | 139/384 |
| 5,348,056 | 9/1994 | Tsuzuki | 139/384 R |
| 5,449,025 | 9/1995 | Weinberg | 139/11 |
| 5,465,760 | 11/1995 | Mohamed et al. | 139/11 |
| 5,540,260 | 7/1996 | Mood | 139/11 |

OTHER PUBLICATIONS

PCT International Search Report.

*Primary Examiner*—John J. Calvert
*Assistant Examiner*—Robert H. Muromoto, Jr.
*Attorney, Agent, or Firm*—Terry J. Anderson; Karl J. Hoch, Jr.

[57] ABSTRACT

A method of making a three-dimensional stiffener having at least one wall (6, 8) extending outwardly from a generally planar base portion (4) comprises the steps of forming the base portion by weaving at least two layers (16, 18) using orthogonally disposed first and second yarn lengths (10, 12) and using a third plurality of yarn lengths (14) located within planes extending perpendicularly to the general plane of said stiffener. Each of said plurality of yarn lengths in said third pluratlity is woven between the topmost and bottommost ones (10, 12) of said plurality of first and second orthogonally disposed first and second yarn lengths. At least one stiffener wall (6) extending orthogonally to said plane is formed by overweaving along a given section of said planar portion and in a direction perpendicular to said general plane of said stiffener coincident with a section of one of said plurality of first and second yarn lengths.

11 Claims, 2 Drawing Sheets

AUTOMATED THREE-DIMENSIONAL METHOD FOR MAKING INTEGRALLY STIFFENED SKIN PANELS

BACKGROUND OF THE INVENTION

The present invention relates to a woven material, used for example in the making of panels which are impregnated with a resin, and relates more particularly to an improvement in such a material and related method wherein a three dimensional structure is formed using a continuous weave forming walls extending orthogonally with one another and each being integrally formed with the other through a common skin to create a high strength unibody stiffener.

In the fabrication of composite materials, it is known to use textiles or filamentary strand materials to reinforce the structures which are created. These reinforcing materials may take many different forms. For example, these strand materials may take the form of polymeric, glass, carbon, ceramic or other industrial fibers. Hence, such composite materials enjoy the benefits of high strength, light weight, and ability to be shaped to a desired configuration.

It have been found particularly useful to create panels with reinforcing walls extending in two coordinate directions and still have the reinforcing walls be connected to a base skin to provide the requisite overall strength for the structure as designed. Obviously, the drawbacks involved with forming a panel of this type using a conventional three dimensional weave system are numerous. One such drawback is that the constraint in constructing a stiffened panel is that the pick yarns which forms the wall section must be continuous through the section.

Accordingly it is an object of the invention to provide a method of ma-king a three dimensional woven fabric suitable for use as a frame member of a composite material that has a substantially planar skin portion with orthogonally disposed walls connected to the skin portion to effect the formation of a stiffened skin panel.

It is another object of the invention to provide a method of making a three dimensional woven fabric of the aforementioned type wherein any size structure is capable of being fabricated according to the method.

Still a further object of the invention is to provide a method of making a three dimensional woven fabric of the aforementioned type wherein the fabric is capable of being formed using any type of multiharness weaving loom.

Yet still a further object of the invention is to provide a method of making a three dimensional woven fabric of the aforementioned type wherein the fabric structure is capable of being formed from any type or diameter yarn.

Another object of the invention is to provide a method of making a three dimensional woven fabric of the aforementioned type wherein yarns are continuously woven through intersecting walls.

SUMMARY OF THE INVENTION

The invention resides in a method of making a three dimensional stiffener having at least one wall extending outwardly from a generally planar base portion. The invention comprises the steps of forming the generally planar base portion of said stiffener by weaving at least two layers using orthogonally disposed first and second yarn lengths and using a third plurality of yarn lengths disposed within planes extending perpendicularly to the general plane of said stiffener, and weaving each of said plurality of yarn lengths in said third plurality between the topmost and bottommost ones of said plurality of first and second orthogonally disposed first and second yarn lengths. At least one stiffener wall extending orthogonally to said plane is formed by overweaving along a given section of said planar portion and in a direction perpendicular to said general plane of said stiffener coincident with a section of one of said plurality of first and second yarn lengths.

DETAILED DESCRIPTION OF THE PREFERRED EMBODIMENTS

Figure 1:
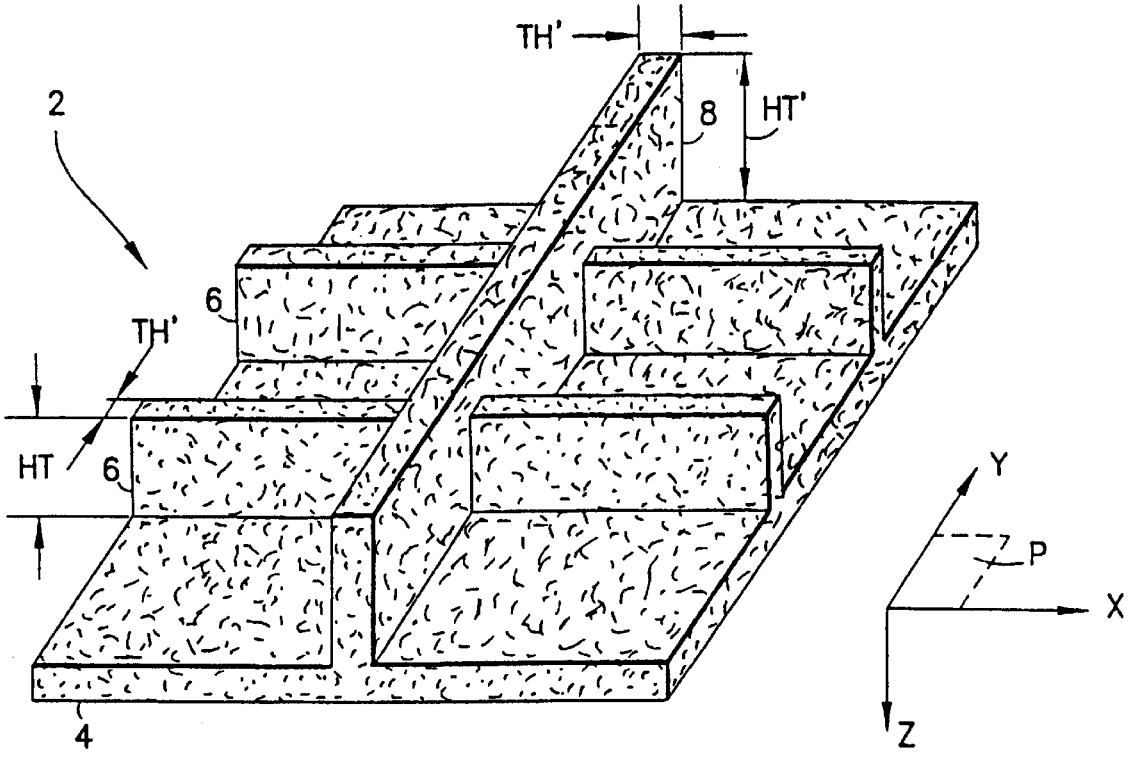
FIG. 1 is a schematic perspective view of the woven stiffener of the invention.

FIG. 1 illustrates a woven stiffener of the invention and is generally illustrated as 2. The stiffener comprises a skin or panel portion 4, a first wall portion 6 and a second wall portion 8, each being connected to the skin portion in accordance with one aspect of the invention. For purposes of this discussion, it should be understood that the first wall portion 6 will be said to extend in a fill direction or in the illustrated X coordinated direction, while the second wall portion 8 will be said to extend in a warp direction, or in the illustrated Y coordinate direction and the skin or panel portion 4 will be said to extend in a plane P which is coextensive with the fill and warp directions X and Y. Also, each of the first and second wall portions 6 and 8 will be said to extend perpendicularly outwardly of the plane P in the illustrated Z coordinate direction and will be referred to as woven stiffeners. The term "fabric" is meant to mean any section of the stiffener which is constituted by the yarns of the structure. The term "yarn" will be used to define any flexible elongated material which is capable of being used in a stiffener, such as but not limited to, any size or type of yarn, and/or variety of textile and industrial fibers, made up of polymeric, glass, carbon, ceramic or other materials commonly known in the industry.

Referring first to the general structure of the woven stiffener 2, it should be seen that the method of the present invention weaves the stiffener in such a way as to define the skin or panel portion so that it can be considered in two basic components; the section A of fabric which contains the first and second stiffener wall portions 6 and 8 and the section B of fabric which does not. That is, the first and second wall portions 6 and 8 are in effect interwoven regions of the panel portion taken with respect to the remaining panel so as to extend outwardly therefrom in the indicated Z axis direction and along one of the X and Y axes to generate respectively, one of the first and second wall portions 6 and 8.

Figure 3:
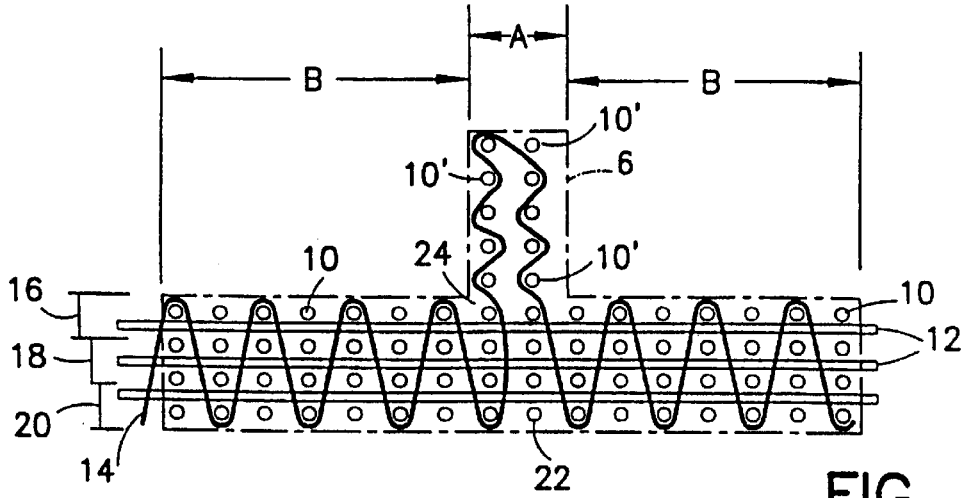
FIG. 3 is a schematic view taken along line 3—3 in FIG. 2 showing. one embodiment of a first wall to base portion connection.
Figure 4:
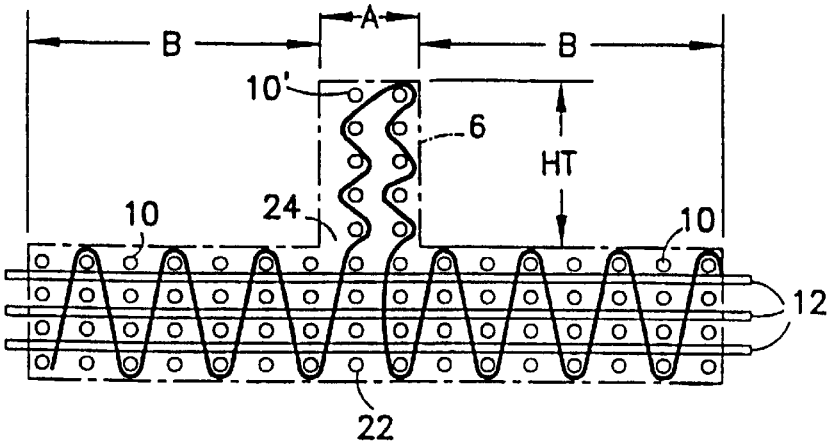
FIG. 4 is an alternative out of phase embodiment of the connection shown in FIG. 3.
Figure 5:
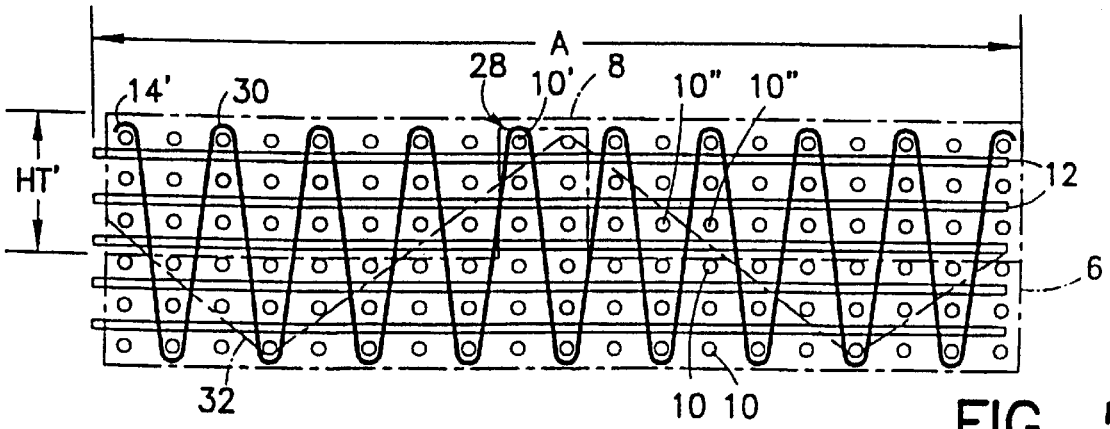
FIG. 5 is a schematic view taken along line 5—5 in FIG. 2 showing the second wall to base portion connection with the first wall superposition being shown in phantom line.

In the illustrated embodiment of FIGS. 3–5, the panel or base portion 4 is formed from intersecting plurality of woven first yarn lengths 10,10 which extend in the illustrated X or fill direction, and a plurality of second yarn lengths 12,12 which extend perpendicularly in the warp or Y coordinate direction and which X and Y coordinate direction yarns 10 and 12 being bound by a third plurality of yarn lengths 14,14 which extend in planes each parallel to one another and disposed perpendicularly to the general plane P of the panel or base portion 4 to bind the stiffener 2. That is, each of the yarns 14,14 making up the third plurality 14,14 periodically lace between the topmost and bottommost ones of the plurality of first and second yarns 10 and 12 to create, within the panel portion 4 a plurality of layers 16, 18 and 20. The panel portion 4 which defines the base of the stiffener thus consists of all the yarns namely 10, 12, and 14 which are needed to create the first and second stiffener wall portions 6 and 8. While shown in the illustrated embodiment of FIGS. 3–5 as being constituted by three layers, it should be understood that the planar base panel portion 4 of the stiffener 2 can however be comprised of as few as two layers to effect the process of the present invention.

As illustrated in FIGS. 3–5, the sections A,A identify areas on the base or panel portion 4 designated for the formation of a first and second wall portion, is set forth in the memory of a computer or like data storage device. As seen in FIGS. 3 and 4, the area A defines the location of a first wall portion 6, and accordingly, corresponds to an increased application of the fill or X axis directed yarns 10',10' along the Z coordinate axis to define a height HT outwardly of the plane P defining the base or panel portion 4 of the stiffener and to define a thickness TH as measured along the Y coordinate axis.

As illustrated in FIGS. 3 and 4, the binding yarn 14 is caused to be periodically woven between the topmost and bottommost ones of the yarns which are located within the panel portion 4. However, the binding yarn 14 is caused to skip one column 22 of the yarns 10,10 as it departs from its otherwise serpentine path and be redirected outwardly (FIG. 3) through passage 24 defined by the most proximately juxtaposed pair of yarns 10 and 10'. The binding yard continues in a serpentine manner between the yarns 10',10' which are arranged along planes disposed parallel to the indicated Z axis in the first wall portion 6. Once reaching the topmost one of the yarns 10', the binding yarn 14 is caused to be turned and be redirected back toward the panel portion 4. In so doing, a topmost one of the yarns 10' as illustrated at point 26 is skipped.

It should be understood that as between consecutive ordered rows of the binding yarns 14,14, the connection shown in FIG. 3 may be made out of phase in the illustrated embodiment of FIG. 4, such that binding of the first wall portion 6 occurs along the indicated X axis in an alternating manner as defined by the phased and out of phased binding techniques shown in FIGS. 3 and 4 so that any skipped topmost one of the yarns 10',10' can be bound by the next succeeding binding yarn in the succeeding row. It should nevertheless be understood that there are a variety of paths that the Z axis binding yarns can take with respect to the fabric structure shown and the two types illustrated schematically in FIGS. 3 and 4 illustrate only one pair of possible Z axis yarn paths that might be used in constructing the first stiffened wall portion 6. Also, while discussed as being arranged in an alternating manner, the exemplary Z axis yarn paths of FIGS. 3 and 4 may be disposed adjacent to each other as opposed to being consecutively separated from one another by the warp or Y axis yarns.

The aforementioned overweave method may be accomplished by employing a multi-harness weaving loom of any nature to effect the raised wall structure. In addition, jacquard, dobby, cam, hand-loom, or other type of lifting motion can be used and either shuttle or shuttless filling insertion can be used. Warp beams or creels may be employed for yarn supply. Small or large looms can be used in this method. Thus, the automated method of the present invention uses a loom for producing integrally woven stiffener walls 6 and 8, oriented in both the warp and filling directions attached to the base panel portion 4 through the intermediary of a plurality of Z-axis yarns.

Referring now to FIG. 5, and to the construction of the second stiffener wall portion 8, it should be seen that the area A as defined by the second wall portion 8 corresponds to an increased application of the fill or X axis directed yarns 10", 10" in the Z coordinate axis direction to define a height HT' outwardly of the plane P defining the base or panel portion 4 of the stiffener and to define a thickness TH' as measured along the X coordinate axis (or into the page). The thickness TH' is made up of truncated lengths of the plurality of first yarn lengths 10" and the full lengths of the plurality of first yarn lengths which constitute the first stiffener wall portion 6.

Figure 2:
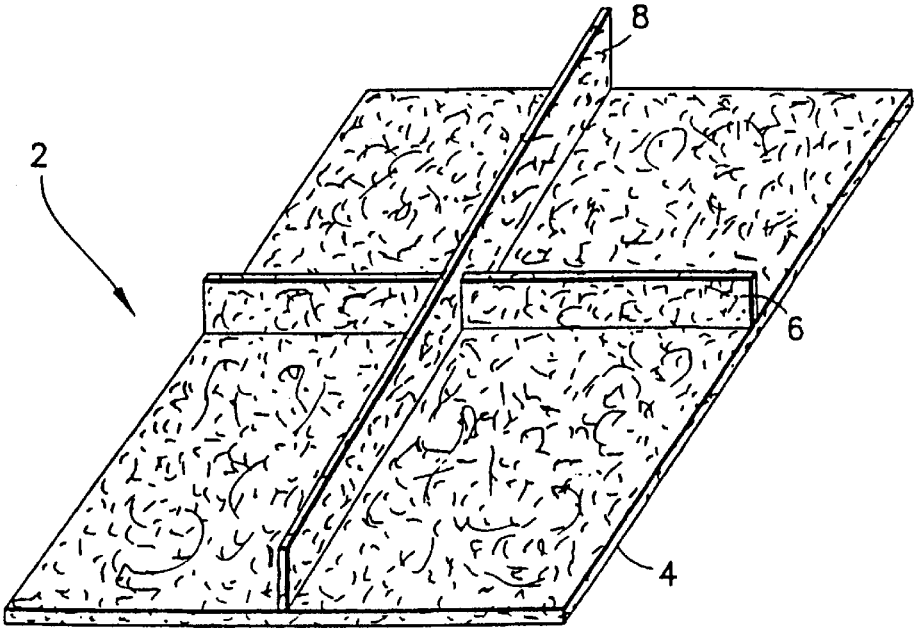
FIG. 2 is a perspective view showing one intersection within the stiffener of FIG. 1.

As illustrated in FIG. 5, the binding yarn 14 is caused to be periodically woven between the topmost 10", 10' and bottommost 10 ones of the yarns 10 which are located within the panel portion 4 and which make up both of the wall portions 6 and 8. That is, in the embodiment of FIG. 5, a section is taken at the intersection between stiffener wall portions 6 and 8, and thus, the phantom line outline is provided to illustrate the existence of the intersecting outline 28 of the first stiffener wall portion 6. Thus, at an intersection between first and second stiffener wall sections 6 and 8, the second stiffener wall portion 8 will be made up of the yarns identified as 10,10 constituting the base or the panel section 4, yarns 10', 10' constituting the first wall section 6 and yarns 10", 10" which constitute the remainder of the desired wall profile not made up by the base and the first wall sections. When the first and second wall portions 6 and 8 are intersected, as shown in FIG. 2, the warp and filling yarns pass across each other with no crimp and there are continuous, straight yarns passing in both warp and filling directions through the intersection of the first and second wall stiffeners 6 and 8.

Normally, the binding yarn illustrated in FIG. 5 as element 14', will follow a serpentine path through the base or panel portion 4 when in the nonoverweave section B,B, and will be diverted out of the plane P, in the case where a first wall section is being formed. However, in the case where a second wall portion 8 is being formed, the binding yarn 14' extends throughout the entire height HT' of the second stiffener wall portion 8 so as to be woven through the entire depth of the wall as constituted by yarns 10, 10' and 10". The path followed by the binding yarn 14' may take may different forms, as mentioned above. As illustrated in FIG. 5, the path 30 represents one way in which the binding yarn 14' may travel, wherein the frequency of the yarn between the uppermost and lowermost yarns is at its maximum. The path 32 represents an alternate path which the binding yarn may follow wherein the frequency of the binding yarn 14' between the uppermost and lowermost yarns is very low. In addition, as mentioned above, the periods of the binding yarn length 14' through the second stiffener wall portions 8,8 will be out of phase with one another as between consecutively ordered side by side lengths of the binding yarn 14' to effect capture of all yarn lengths extending in the fill or X coordinate direction.

The method of construction discussed above, as previously mentioned, can be practiced on a traditional weaving loom. However, to assist in the formation of the structure, a specially modified warp yarn guide may be employed which holds the warp 12,12 and binding Z axis yarns 14,14' in place at the initial stages of weaving. To assist in accurate placement of the binding yarns, a support bar may be added to the loom, and which bar holding the Z yarns in either up or down positions (as appropriate) during successive placement of filling yarns. The purpose of such a bar is to provide the same motion implied by the harness lifting (dropping), but to add additional clearance at the fell of the cloth. A similar effect can be achieved with adequate lift of the harnesses and/or hooks.

While the present invention has been described in the preferred embodiment, it should be understood that numerous substitutions and modifications may be used without departing from the spirit of the invention. For example, the shape of the wall stiffener portions can change as a function of position down the length of the stiffener. Curvature can be incorporated in the integrally woven panel through weave design allowing the entire panel to curve across the fill axis or the warp axis, or both. thus the reference to a plane constituted by the panel is meant to mean a plane which extends normal to the top surface of the panel. Also, the thickness of the panel or base portion can vary in the warp and/or filling direction. This can be accomplished by selective yarn size placement (filling direction taper) or change in pick yarn size and pick yarn frequency (warp direction taper).

We claim:

1. A method of making a three dimensional stiffener having at least one wall extending outwardly from a generally planar base portion comprising the steps of:

forming the generally planar base portion of said stiffener by weaving at least two layers using a plurality of orthogonally disposed first and second yarn lengths and using a third plurality of yarn lengths disposed within planes extending perpendicularly to the general plane of said stiffener, and weaving each of first and second yarn lengths such that said third plurality of yarn lengths extend between the topmost and bottommost ones of said plurality of first and second orthogonally disposed first and second yarn lengths; and forming at least one stiffener wall having a height defined by a free end and which the at least one stiffener wall extending generally in a plane orthogonally to said plane of said base portion by overweaving said first and second yarn lengths along a given section of said otherwise planar base portion and in a direction of the height of said at least one stiffener wall such that said stiffener being coincident with said section of said overweaved first and second yarn lengths.

2. A method as defined in claim 1 further characterized by periodically weaving each of said plurality of yarn lengths in said third plurality between the topmost and bottommost ones of said plurality of first and second orthogonally disposed first and second yarn lengths.

3. A method as defined in claim 2 further characterized by the step of periodically weaving between the topmost and bottommost ones of the yarns occurs using in a row a single length of said plurality of yarn lengths in said third plurality to bind said topmost and bottommost ones of said plurality of said orthogonally disposed first and second yarn lengths.

4. A method as defined in claim 3 further characterized by said topmost and bottommost ones of the yarns being defined by said plurality of first yarn lengths.

5. A method as defined in claim 4 further characterized by said plurality of yarn lengths in said third plurality being binding yarn lengths and a length of said binding yarn length being caused to skip one column of said plurality of first yarn lengths and depart from an otherwise serpentine path so as to be redirected outwardly normally of said generally planar said base portion.

6. A method as defined in claim 5 further characterized by the binding yarn length continuing in a serpentine manner between said plurality of first yarn lengths the yarns which are arranged along planes disposed parallel to one another and normally to the generally planar base portion and upon reaching the topmost one of the first yarn lengths, said binding yarn length being caused to be turned and be redirected back toward the generally planar base portion.

7. A method as defined in claim 6 further characterized by as between consecutive ordered rows of the binding yarn lengths, the periodic serpentine binding connection is caused to be made out of phase.

8. A method as defined in claim 7 further characterized by forming at least another stiffener wall perpendicularly to and intersecting with the at least one stiffener wall and causing the at least another stiffener wall to be made up of truncated lengths of said plurality of first yarn lengths and full lengths of said plurality of first yarn lengths.

9. A method as defined in claim 8 further characterized by the step of forming the at least one stiffener wall with the step of forming an underlying section of said base portion.

10. A method as defined in claim 8 further characterized by the step of forming the at least another stiffener wall with the forming of an underlying section of said base portion.

11. A method as defined in claim 10 further characterized by the step of forming the at least another stiffener wall with the forming of a portion of said at least one stiffener wall and an underlying section thereof of said base portion.

* * * * *